United States Patent [19]

Schwarze

[11] Patent Number: 4,888,971

[45] Date of Patent: Dec. 26, 1989

[54] PIPE BENDING MACHINE

[76] Inventor: Rigobert Schwarze, Olpener Str. 460–474, 500 Köln 91, Fed. Rep. of Germany

[21] Appl. No.: 246,453

[22] Filed: Sep. 19, 1988

Related U.S. Application Data

[63] Continuation of Ser. No. 47,988, May 7, 1988, abandoned.

[30] Foreign Application Priority Data

Aug. 14, 1986 [DE] Fed. Rep. of Germany ..... 3616302

[51] Int. Cl.[4] ..... B21D 7/04

[52] U.S. Cl. ..... 72/157; 72/159

[58] Field of Search ..... 72/149, 154, 155, 157, 72/158, 159

[56] References Cited

FOREIGN PATENT DOCUMENTS 1297064 6/1969 Fed. Rep. of Germany .
1917926 10/1969 Fed. Rep. of Germany ..... 72/157
2626202 6/1976 Fed. Rep. of Germany .
2711340 7/1979 Fed. Rep. of Germany .
3407499 9/1984 Fed. Rep. of Germany .
59-178131 10/1984 Japan ..... 72/157

*Primary Examiner*—E. Michael Combs
*Attorney, Agent, or Firm*—Michael J. Striker

[57] ABSTRACT

A pipe bending machine having a support, a bending template, a clamping jaw displaceable relative to the bending template, a clamping member for a pipe, and clamping bodies each provided in a respective one of the bending templates and the clamping jaw and movable relative to one another to an operative position, one of the clamping bodies havign a clamping surface which is provided with different contours for portions of a pipe to be clamped, while the other of the clamping bodies being provided with a clamping surface having only one contour corresponding to the portion of the pipe to be clamped so that the portion of the pipe to be clamped is engaged over its whole surface at the respective side over an angular distance of 180°.

4 Claims, 2 Drawing Sheets

PIPE BENDING MACHINE

This is a continuation, of application Ser. No. 047,988, filed May 7, 1987 abandoned.

BACKGROUND OF THE INVENTION

The present invention relates to a pipe bending machine. More particularly, it relates to such a pipe bending machine which has a bending table turnable about an axis, a bending template, and a clamping jaw displaceable relative to the bending template with displaceable carriage which carries a rotatable clamping sleeve. In such a machine both a bending template and the clamping jaw have straight and curved portions and mutually associated clamping bodies which are provided with clamping surfaces for clamping a pipe to be bent and which are spaced from one another and at the same time can be brought to an operative position.

The German document DE-AS No. 1,297,064 published in 1969 describes a fully automatic pipe bending machine for bending pipes which have interconnected arcs located in different planes. In this machine a bending template which is separable at the end of bending from its rotary drive, and an associated pipe clamping jaw are provided with a pipe groove which lies in the bending plane and are also provided with a laterally branching groove which corresponds to the course of the curved pipe. The machine also has a pressing device acting outwardly and engaging transversely the non-bent pipe directly in front of the bending template. Finally, the machine also has a return rotary device for the template separated from the drive, and an adjusting device for the bending template which is activated during pressing of the pipe by the template.

Since the bending template and the clamping jaw are formed of one-piece with the pipe groove lying in the bending plane and with the pipe groove extending therefrom, the above mentioned branching does not provide an embracing full-surface clamping of the pipe. A knot point of the straight and the branching path or groove is not possible in practice, as long as after first bending the pipe is turned for the subsequent bending pipe approximately 90° in the bending plane. When it is turned by deviating values or smaller bending angle, the clamping surfaces of the grooves are so small that a bending is not practically possible, since a notcontrollable slippage takes place which prevents an accurate bending. The very small clamping surfaces lead in many cases to a damage to the pipe, such as a pressing-in in connection with a cross section reduction and grooving during a slippage.

The above described arrangement operates in the following manner: After the formation of the first curve, the bending template is fixed in its position which corresponds to the respective curve shape. After this, the loose clamping jaw is brought back to its original position. Then the bent end of the pipe is pressed outwardly under force radially to the template out of the pipe groove and turned over simultaneously into the new bending plane. When then the adjusting device releases the template, it is returned by the return turning device to its initial position. When then the pressing device for the pipe is turned off, the pipe turns either itself or under the action of the clamping jaw until it again abuts against the template so that the produced pipe curves are inserted in the branching groove of the template and the loose clamping jaw. The pipe is clamped for the production of the next curve, which is performed in a conventional manner by joint rotation of the template and the loose clamping jaw.

Since the arrangement in accordance with the above discussed German document DE-AS No. 1,297,064 does not give satisfactory results, several proposals have been developed for providing different clamping surfaces during bending of pipes. One of such proposals is disclosed in the German patent No. 2,626,202 of the inventor, in which the clamping surfaces are separated spatially from one another and are rotatable relative to the bending table.

The German document DE-AS No. 2,711,340 discloses an arrangement for cold bending of strand material, such as pipes, rods and profiles, which has a bending shaping piece rotatable about an axis and provided with a peripheral groove for receiving a strand material, and a clamping device which core rotates with the bending shaping piece and has a clamping jaw arranged on the bending shaping piece and a counterclamping jaw. The clamping jaw and the counterclamping jaw are provided with a groove which together form a receiving passage for the strand material. Moreover, the bending shaping piece has in some cases further peripheral grooves, the clamping jaws and the counterclamping jaws are provided with further different grooves associated with the peripheral groove of the bending shaping piece, and the clamping jaw with the counter jaw on the one hand and the bending shaping piece on the other hand are adjustable relative to one another for exchanging the receiving passage in direction of the axis of the bending shaping piece.

The German document DE-OS No. 3,407,499 of the Applicant discloses a machine in which the bending template and/or clamping jaw have an abutment surface, particularly a receptacle for exchangeable receipt of a body provided with the clamping surface. This body is arranged in a guide and provided with a drive which drives the body in a vertical movement into the receptacle and out of the same. In this receptacle, at the location of the body provided with a clamping surface, another body is movable in and out and provided with a clamping surface of another shape.

The above discussed three documents disclose the arrangements in which the respective portion of the pipe to be clamped must be engaged or surrounded for clamping over a complete surface, or in other words over its entire periphery. In the event of different spatial shapes which have the portion of the pipe to be clamped, for example when the pipe has an expanded and not expanded end to be clamped or depending on the preceding bending of a pipe portion, this requires completely different clamping bodies with a respective clamping surface associated with each clamping body. The prior art proposes different solutions for provided this clamping body with individually associated clamping surfaces. The above mentioned German patent No. 2,626,202 discloses the clamping bodies which are arranged on the bending template and distributed over its periphery, while they are arranged on the clamping jaw in a rotatable manner and thereby are concentrated locally. In the German document DE-AS No. 2,711,340 the clamping bodies arranged on the clamping jaw and the clamping bodies cooperating with the bending template form a structural unit which is mounted on the clamping jaw support and moved together with it.

SUMMARY OF THE INVENTION

Accordingly, it is an object of the present invention to provide a pipe bending machine which is a further improvement of the pipe bending machines known in the art.

More particularly, it is an object of the present invention to provide a pipe bending machine which has a bending template with a clamping jaw mounted thereon and a counter jaw mounted on a clamping jaw support, in which with smaller structural expenses or a number of clamping jaws, a plurality of clamping surfaces of different spatial shapes can be provided.

In keeping with these objects and with others which will become apparent hereinafter, the inventive clamp bending machine has a bending table which is turnable about an axis, a bending template and a clamping jaw displaceable relative to the bending template, and a displaceable carriage which has a rotatable sleeve, wherein the bending template and the clamping jaw have straight and curved portions for clamping associated clamping bodies which correspond to a pipe to be bent and which are provided with clamping surfaces, the clamping bodies are spatially separated from one another and bringable to an operative position, wherein in accordance with the invention one clamping body has one clamping surface which has several different contours of the pipe portions to be clamped, while the associated clamping body has only one clamping surface corresponding to the contour of the pipe portion to be clamped, and thereby the pipe portion to be clamped is engaged over a full surface at the associated portion over an angular distance of 180°.

When the machine is designed in accordance with the present invention, one clamping jaw has a clamping surface designed as a semi-shell which is semi-shell shaped over its entire length, so that the pipe portion abutting against it is engaged over the length of the clamping over an angular distance of 180°, while the opposite clamping jaw has several clamping surfaces over different spatial shapes which surround the inserted portion of the pipe to be clamped in certain regions only partially about 180°, so that in other words there is no there a complete clamping. It was recognized that during bending of the pipes it is sufficient to provide a full-surface clamping only over a half of the pipe cross section over the length of the clamping, while the opposite half can be clamped only in zones in a semi-shell like manner or over 180° so that the clamping surface has gaps which are or can be visible. When the inventive solution is implemented, one clamping jaw with several different clamping surfaces is or can be supported fixedly and does not require any drive.

It was further recognized that this is also true for the semi-shell like complete clamping at the clamping shell mounted on the bending template or at the clamping jaw provided on the clamping jaw support. Therefore in accordance with the further embodiment of the invention it is proposed that the clamping body arranged on the clamping jaw is rotatable and provided with several clamping surfaces distributed over its periphery, while each individual clamping surface has a clamping surface which corresponds to the pipe portion to be clamped, and the bending template has a clamping body with a clamping surface which has several different contours for the pipe portion to be clamped.

This proposal has the advantage that the arrangement of several clamping surfaces of different shapes in one clamping jaw or in some cases clamping jaws arranged over one another and axially displaceable on the bending template results in their local concentration at one point so as to make possible the unobjectionable bending of the pipe by up to 180°. It is especially advantageous in this proposal that in the clamping jaw arranged on the bending template, two or more different clamping surfaces can be provided in one clamping jaw. This inventive solution makes possible arranging of different clamping surfaces on one clamping jaw. This provides for a further advantage in that the clamping jaw arranged on the bending template can be screwed with the bending template, so that in the sense of movement only the counterclamping jaw arranged on the clamping jaw support is to be adjusted.

The inventive solution, particularly in connection with the above described features that the clamping jaw mounted on the bending template has several different clamping surfaces, which mounting means that the clamping jaw can be also axially movable in the bending template and also can be screwed at a certain location, makes possible to perform a method of bending in accordance with which after bending of the pipe by an adjusted bending angle by rotation of the bending template with abutting clamping jaw, the clamping jaw is released from the bending template, and the bending template is further turned in condition of no-supply of pipes by such an amount that the clamped portion of the pipe is removed from the clamping surface and the pipe is rotated about its non-bent longitudinal axis from the clamping surface of the bending template, and then the pipe supply for the next bending and simultaneously the return rotation of the bending plate to its initial position is performed.

In the known arrangements and designs of the clamping jaw and counterclamping jaw, after the end of the bending process and the release of the counterclamping jaw in condition of stopped bending template, the pipe is moved further, so that the bent end is withdrawn from the clamping surface of the clamping jaw of the bending template, then the bending template is returned to its initial position.

In accordance with the present invention, after the bending, the bending template is further turned by a certain amount so that this additional rotation results in that the clamping surface is removed from the bent pipe end. While till now the bent pipe end was removed from the bending template by this feature, the pipe in condition of the stopped bending template is displaced by a special feature, it is proposed now in condition of the stopped pipe to perform the rotation of the bending template over the value required for bending and so that the bent pipe end is no more in the clamping surface and thereby in condition of the stopped pipe of the bending template, is moved further. This has the advantage in that the control is simplified, since after bending of the pipe it retains its position while the bending template is further rotated over the value required for bending. This further rotation is performed in one working step, since with this further rotation no further bending of the pipe is performed, but only the release of the counterclamping jaw.

The inventive proposal leads to an end result in that the movement course is simplified and the accuracy of the bending is increased. In known methods, for releasing the bent pipe portion form the clamping surface the clamping located on the bending template further moved the pipe by an additional movement in its axial direction. This additional movement for releasing from the clamping jaw had to be taken into account in the control program so that the neck bending had to be performed after a respective pipe displacement at a proper location. The displacement for movement of the bent pipe portion from the clamping jaw must, therefore, be considered. It should be mentioned that for determination and execution of the bending program it is respectfully simple that the bending template is moved outside with the clamping jaw mounted thereon, by a value required for the bending.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
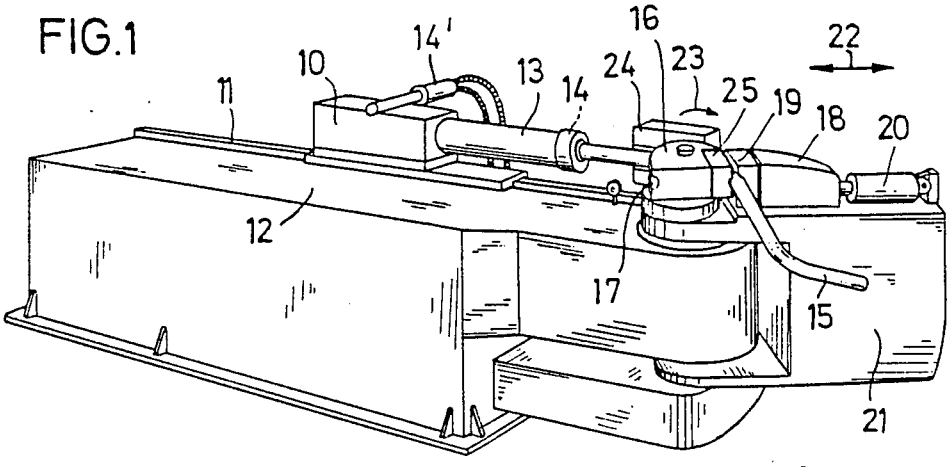
FIG. 1 is a perspective view of a pipe bending machine.

FIG. 1 shows a conventional pipe bending machine with a displacing carriage 10 which can reciprocatingly slide over the upper side of a machine housing 12 on one or several guiding rails 11. The displacing carriage 10 has a hollow cylinder 13. A clamping sleeve 14 is arranged in the interior of the hollow cylinder 13 and has an end region for clamping a pipe piece or pipe 15 to be bent. The pipe piece 15 is guided around a turnably supported bending template 16. The bending template 16 has a groove 17 provided for the pipe and corresponding to the semidiameter of the pipe. A clamping jaw 19 is pressed against a part of the pipe piece 15 extending around the bending template 16. The pressing is performed by means of a clamping device 18. The clamping jaw 19 also has a groove which corresponds to the semidiameter of the pipe, and clamps the pipe 15 against the bending template 16. For this purpose, the clamping template is provided with a clamping jaw 25 which is arranged on the clamping template and is releasably connected therewith.

A hydraulic cylinder-piston unit is used for example for moving the clamping device 18 of the clamping jaw 19 toward the bending template 16 for fixing the pipe and for withdrawing the same from the bending template. The bending template 16 is fixedly mounted on a bending table 21. The clamping device 18 is reciprocatingly displaceable via the cylinder-piston unit 20 in the shown direction identified by the arrow 22. When the bending template 16 is turned over the bending table 21 together with the clamping jaw 19 in direction of the arrow 23, then the pipe piece 15 obtains a curvature which corresponds to the profile of the bending template 16. During this bending step the end part of the tubular piece 15 remains clamped in the clamping sleeve 14 of the displacing carriage 10, for reliably guiding the pipe piece in all positions. For preventing lateral buckling of the free pipe piece 15 between the clamping piece 14 and the bending template 16, a sliding rail 24 is pressed against this portion of the pipe piece. The sliding rail 24 also has a groove which corresponds to the semidiameter of the pipe. The clamping sleeve 14 of the displacing carriage 10 does not clamp the pipe piece 15 fixedly, but it turns by the angular distance up to 360° when successive bendings of the pipe must be curved in different directions. For turning the clamping sleeve 14, a hydraulic motor turns a screw which cooperates with a not shown screw wheel connected with the clamping sleeve 14.

Figure 2:
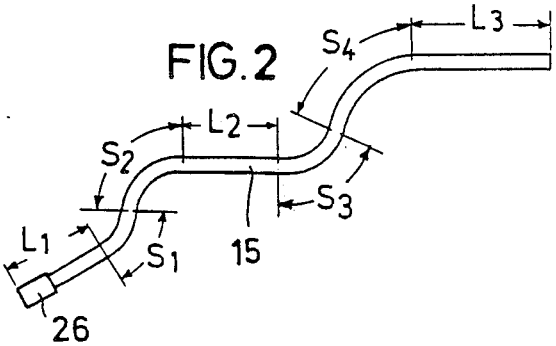
FIG. 2 is a perspective view of a bent pipe.

FIG. 2 shows an exhaust pipe which is produced in the bending machine and has bent portions or pipe bends S 1 and S 2, as well as S 3 and S 4 which follow one another. It also has straight intermediate portion L 1, L 2 and L 3, which however up to the length L 1 cannot be used. The pipe is provided at its front end with an extended part 26.

Figure 3:
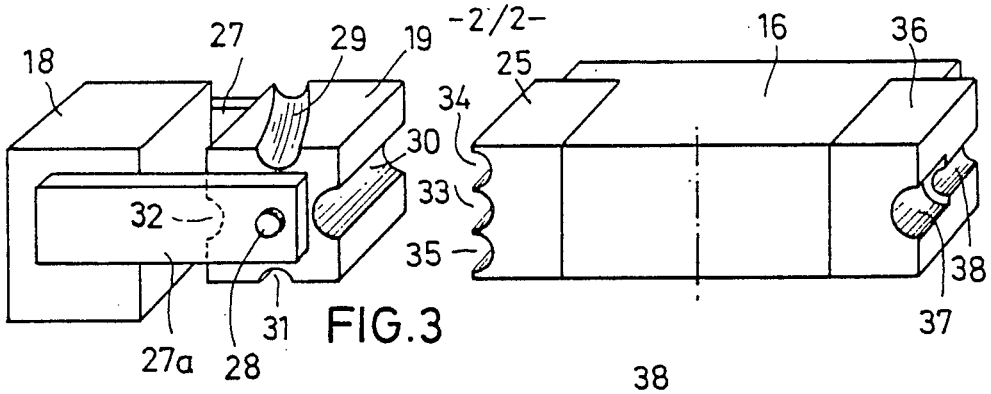
FIG. 3 is a perspective view of a bending template with clamping jaws and counterclamping jaws.
Figure 4:
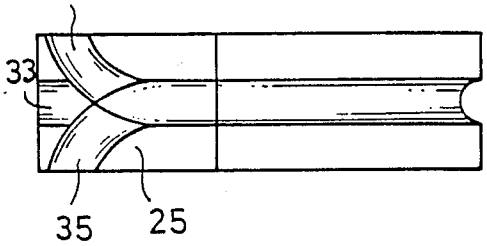
FIG. 4 is a view showing a vertical section of a bending template with a double clamping jaw which is arranged on it and movable in an axial direction.

FIG. 3 shows that the clamping device or a clamping jaw holder 18 is provided at its both sides with beams 27 and **27*a* which extend in direction toward the bending template 16 and connected at their front end with the counterclamping jaw 19 by means of a pivot axle 28. The counterclamping jaw 19 is formed in this embodiment as a rectangular body having four clamping surfaces. The clamping surfaces of the counterclamping jaw have depressions with a semi-circular cross section so as to form clamping surfaces 29, 30, 31 and 32. These clamping surfaces have different spatial shapes. At the same time, their common feature is that they engage a tubular portion to be clamped over the entire clamping length in a semi-circular manner. The clamping jaw 25 arranged on the bending template 16 has three different peripheral grooves 33, 34 and 35 which are also shown in FIG. 4. The clamping jaw 25 is mounted on the bending template 16** by not shown screws so that it cannot displace relative to the bending template. This solution is especially advantageous since in this construction no movement mechanism is required.

As can be seen from FIG. 3, a further clamping jaw 36 is arranged on the clamping jaw 25 opposite to the bending template 16. The clamping jaw 36 has a clamping surface with different radii of their semi-shells. A part 37 has a greater radius of curvature, while a part 38 has a smaller radius of curvature. Thereby the pipe 15 shown in FIG. 2 is clamped by the semicircular part 37 in its end portion 26, while the remaining part with the smaller radius is clamped in the portion 38.

FIG. 4 shows that the clamping jaw 25 with its depressions 33, 34 and 35 cannot engage the respective clamped pipe portion over half of circular surface. It also engages the same in the regions in which the depressions 34 and 35 intersect one another and also in a non-complete manner.

However, in the present invention the situation is not damaging as long as the counterclamping jaw engages the pipe over the angular distance of 180°, or in other words in a semi-shell manner, over the length of the pipe portion to be clamped in a complete manner.

Figure 5:
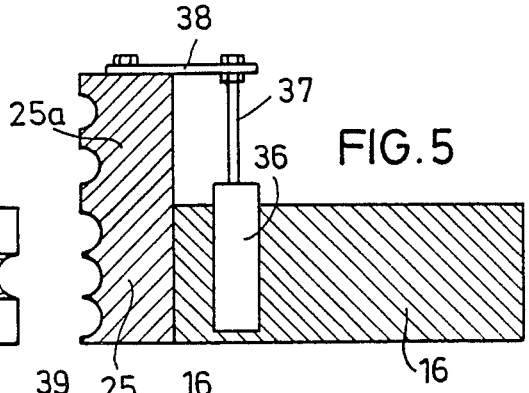
FIG. 5 is a view showing a bending template with clamping jaws which have several different clamping surfaces.

FIG. 5 shows the bending template 16 on which two clamping bodies 25 and 25a are arranged over one another. The clamping body 25 has three different clamping surfaces, while the clamping body 25a has two different clamping surfaces. The clamping bodies 25 and 25a are adjustable in a vertical direction by a hydraulic cylinder-piston unit. A cylinder 36 of the unit is arranged inside the bending template 16, while a piston rod 37 of the unit extends outwardly and has a transverse support 38 connected with the clamping bodies or jaws 25 and 25a. By means of the cylinder-piston unit, it is possible to make selectively operable either the clamping jaw 25, or the clamping jaw 25a by lowering the jaws.

It should be mentioned that the solution shown in FIG. 5 proposes the bending template on which also the counterclamping jaw holder 18 can be provided. In this construction, in deviation from FIG. 3, the clamping surfaces are arranged not on a body which is rotatable about a horizontal axis, but on a body which is displaceable in a vertical plane. It should also be mentioned here that the clamping surfaces arranged over one another are not so favorable as the clamping surfaces arranged in different planes as shown in FIG. 3 and rotatable about the rotary axle 28. In many cases it is possible to use three surfaces, but also it is possible to use five or six surfaces.

Figure 6B:
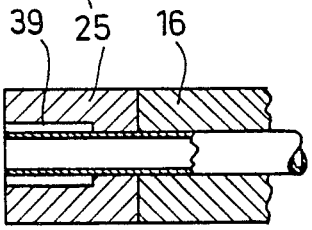
FIG. 6A–6C are views showing a bending template in FIG. 6B and 6C, with incorporated clamping jaws, which is associated with a couterclamping jaw shown in FIG. 6A.
Figure 6A:
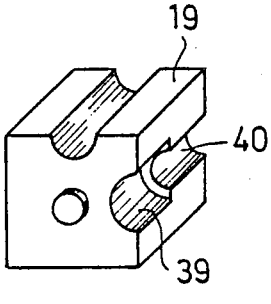
Figure 6C:
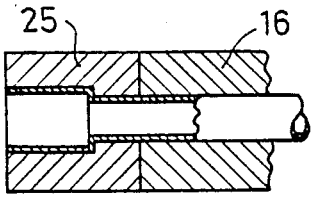

As shown in FIG. 6, the bending template 16 illustrated in FIG. 6B and 6C has a clamping jaw 25 with a unitary formation of their clamping surfaces shown in perspective in FIG. 6A. As a result of this, it has a semi-shell 39 with a greater diameter and a semi-shell 40 with a smaller diameter, for example for clamping the expanded pipe end 26 and the following portion of the pipe with a conventional diameter. The counterclamping jaw 19 in correspondence with FIG. 6A shows a shape with which the pipe portion to be clamped is engaged over the angular distance 180° over the length of the pipe portion to be clamped. The clamping jaw 25 arranged on the bending template 16 and shown in FIG. 6C also provides for a complete clamping extending over an angular distance of 180°. However, FIG. 6B shows a complete clamping only for a selected pipe diameter, and not in the clamping portion 39.

Figure 7:
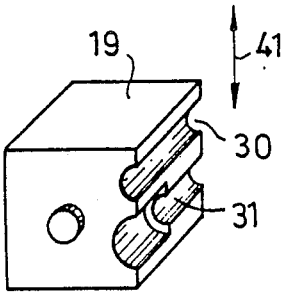
FIG. 7 is a view showing a counterclamping jaw which is provided on its surface with several different clamping surfaces.

FIG. 7 shows the counterclamping jaw 19 which is provided on its clamping side with several clamping surfaces, namely two clamping surfaces. With respect to their semi-shells, they are formed individually and completely. They cooperate with a counterclamping surface which with respect to the length of the counterclamping surface does not completely engage the pipe or in other words over a distance of 180°, as shown for example in the knot point in FIG. 4. For bringing one clamping surface 30 or the other clamping surface 31 in cooperation with the different radii 40 and 39, the counterclamping jaw is displaceably supported in direction identified by the double arrow 41.

It will be understood that each of the elements described above, or two or more together, may also find a useful application in other types of constructions differing from the types described above.

While the invention has been illustrated and described as embodied in a pipe bending machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pipe bending machine having a movable support; a bending template mounted on said movable support; and means for clamping a pipe, said clamping means comprising clamping jaws spatially separate from one another and movable relative to one another to an operative position, one of said clamping jaws being mounted on said bending template while the other of said clamping jaws is mounted on said movable support, one of said clamping jaws having a plurality of superposed clamping surfaces, each of said clamping surfaces being provided with a different contour for various pipe shapes to be clamped while the other of said clamping jaws is provided with a plurality of separate clamping surfaces, each of said separate clamping surfaces having only one contour corresponding to one of said superposed clamping surfaces and to the portion of the pipe to be clamped, so that upon movement of said other clamping jaw, each of said plurality of clamping surfaces can be brought individually into a portion for cooperating with a selected one of said superposed clamping surfaces of said one of clamping jaw.

2. A pipe bending machine as defined in claim 1, wherein said movable support comprises a bending table which is turnable about an axis.

3. A pipe bending machine as defined in claim 1, wherein said clamping means further comprises a displaceable carriage provided with a rotatable clamping sleeve to advance and rotate the pipe.

4. A pipe bending machine as defined in claim 1, wherein said other clamping jaw is rotatable and has a plurality of peripheral surfaces, each of said peripheral surfaces being provided with one of said separate clamping surfaces.

* * * * *